US007241236B1

(12) United States Patent
Chen

(10) Patent No.: US 7,241,236 B1
(45) Date of Patent: Jul. 10, 2007

(54) DART WITH DUAL ACTION ARRANGEMENT

(76) Inventor: Te-Tsao Chen, 6511 San Hugo Way, Buena Park, CA (US) 90620

( * ) Notice: Subject to any disclaimer, the term of this patent is extended or adjusted under 35 U.S.C. 154(b) by 0 days.

(21) Appl. No.: 11/332,119

(22) Filed: Jan. 12, 2006

(51) Int. Cl.
*A63B 65/02* (2006.01)

(52) U.S. Cl. ..... 473/578

(58) Field of Classification Search ..... 473/578, 473/582

See application file for complete search history.

(56) References Cited

U.S. PATENT DOCUMENTS 4,230,322 A * 10/1980 Bottelsen ..... 473/585
5,009,433 A * 4/1991 Reid ..... 473/582
5,603,506 A * 2/1997 Pickup ..... 473/585
5,611,543 A * 3/1997 Bottelsen ..... 473/582
5,947,851 A * 9/1999 Kicks et al. ..... 473/582
6,248,033 B1 * 6/2001 Lowy ..... 473/578
6,524,201 B2 * 2/2003 Fenn ..... 473/578
6,533,688 B1 * 3/2003 Huang ..... 473/578

* cited by examiner

*Primary Examiner*—John A. Ricci
(74) *Attorney, Agent, or Firm*—Raymond Y. Chan; David and Raymond Patent Group

(57) ABSTRACT

A dart includes a dart barrel, a shaft having a sliding end portion, and a dual action arrangement. The dart barrel has a head portion and a shaft channel coaxially extending at the head portion, and defining a head opening at the head portion to communicate with the shaft channel. The dual action arrangement includes a tubular shaft housing detachably mounted at the head opening of the dart barrel, wherein the shaft housing has a sliding slot coaxially aligning with the shaft channel for the a sliding end portion of the shaft sliding therealong. The tubular elastic element is coaxially mounted at the sliding end portion of the shaft for applying an urging force against an inner circumferential wall of the sliding slot so as to minimize a clearance between the sliding slot and the sliding end portion of the shaft.

5 Claims, 6 Drawing Sheets

DART WITH DUAL ACTION ARRANGEMENT

BACKGROUND OF THE PRESENT INVENTION

1. Field of Invention

The present invention relates to a dart, and more particularly to a dart comprising a dual action arrangement which is capable of enhancing the stability of the dart when it is hit on a dart board, and of facilitating easy removal of the dart from that dart board.

2. Description of Related Arts

A conventional dart typically comprises a dart body having a tail portion and a head portion, a flyer mounted on the tail portion, a shaft housing mounted at the head portion of the dart body, and a shaft extended from the shaft housing for hitting on a target.

As a matter of conventional arts, a typical shaft usually has a sharpened tip portion and a connecting portion slidably received in the shaft housing so that when the dart is inserted into the target (such as a dart board), it is easier and more convenient for the player to pull it out from the target. Moreover, it is usual for the shaft to be also rotatably connected at the shaft housing so as to enhance allowable movement of the shaft with respect to the dart housing.

A major problem for this conventional design of the dart is that since the shaft is allowed to have relative motion with respect to the dart housing, therefore, when the dart is hit on the target, the shaft and the dart housing may vibrate vigorously and the entire dart becomes very unstable. The consequence may be that the accuracy of that particular throwing is severely undermined.

The key to the above problem is that there exists unpreventable relative movement of the shaft with respective to the dart body because the very reason for allowing the relative movement is to facilitate easy and convenient removal of the shaft from the target. Of course, one may prevent any relative movement between the shaft and the dart body by securely mounting the shaft thereon any sliding and rotational movement of the shaft is restricted. The problem with this technique is that when the relative movement between the shaft and the dart body is altogether eliminated, it is more difficult for the dart to be pulled out from the target.

SUMMARY OF THE PRESENT INVENTION

A main object of the present invention is to provide a dart comprising a dual action arrangement, which is capable of enhancing the stability of the dart when it is hit on a dart board, and of facilitating easy removal of the dart from that dart board.

Another object of the present invention is to provide a dart comprising the dual action arrangement, which is capable of restricting unnecessary relative movement between a shaft and a dart body while allowing the shaft to slidably move with respect to the dart body. In other words, although the shaft is allowed to slide for easy removal of the dart from a target, its overall stability will not be compromised.

Another object of the present invention is to provide a dart comprising the dual action arrangement, wherein the shaft is allowed to slide and rotate with respect to the dart body without affecting the overall stability of the dart.

Another object of the present invention is to provide a dart which does not involve complicated mechanical components so as to minimize the manufacturing cost of the present invention.

Accordingly, in order to accomplish the above objects, the present invention provides a dart, comprising:

a dart barrel having a head portion and a shaft channel coaxially extending at the head portion, and defining a head opening at the head portion to communicate with the shaft channel;

a shaft having a sliding end portion and a hitting tip; and a dual action arrangement, which comprises:

a tubular shaft housing detachably mounted at the head opening of the dart body, wherein the shaft housing has a sliding slot coaxially aligning with the shaft channel for the a sliding end portion of the shaft sliding therealong; and a tubular elastic element coaxially mounted at the sliding end portion of the shaft for applying an urging force against an inner circumferential wall of the sliding slot so as to minimize a clearance between the sliding slot and the sliding end portion of the shaft while the sliding end portion of the shaft is allowed to linearly slide along the shaft channel during an impact force at the hitting tip of the shaft.

These and other objectives, features, and advantages of the present invention will become apparent from the following detailed description, the accompanying drawings, and the appended claims.

DETAILED DESCRIPTION OF THE PREFERRED EMBODIMENT

Figure 1:
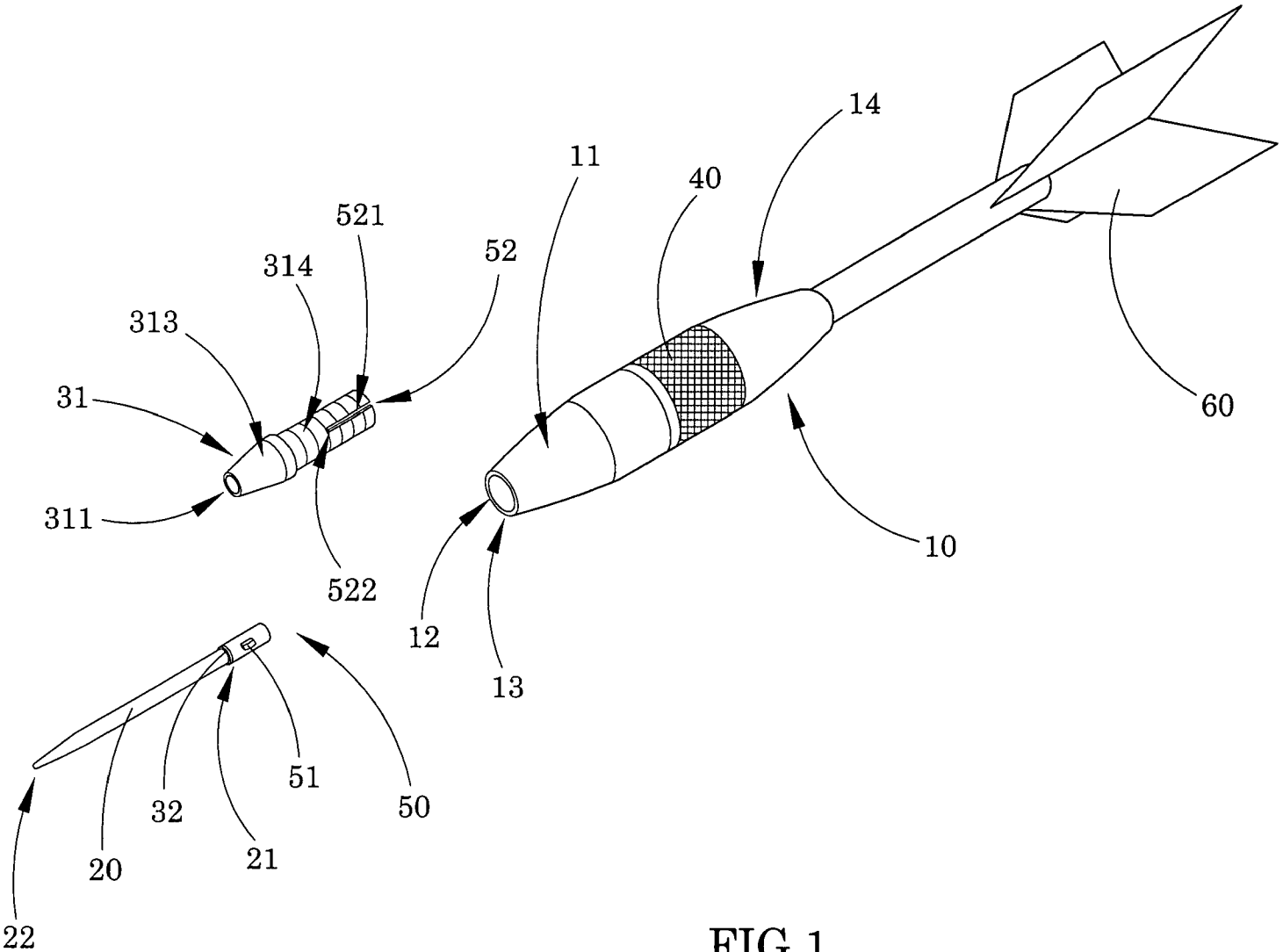
FIG. 1 is an exploded perspective view of a dart according to a preferred embodiment of the present invention.
Figure 2:
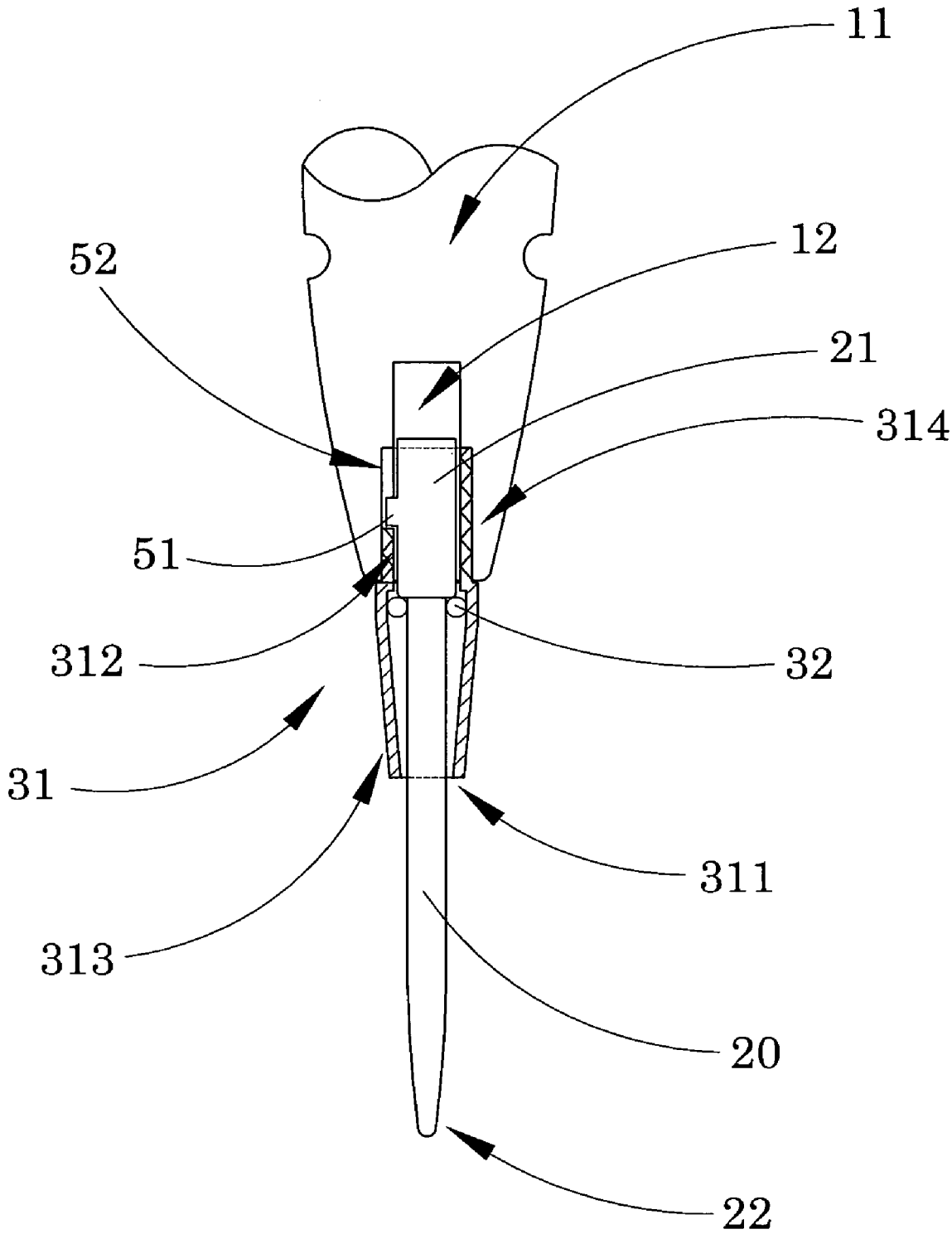
FIG. 2 is a sectional side view of the dart according to the above preferred embodiment of the present invention, illustrating that the shaft is capable of sliding with respect to the dart barrel.

Referring to FIG. 1, FIG. 2 of the drawings, a dart according to a preferred embodiment of the present invention is illustrated, in which the dart comprises a dart barrel 10, a shaft 20, and a dual action arrangement.

The dart barrel 10 has a head portion 11 and a shaft channel 12 coaxially extending at the head portion 11, and defining a head opening 13 at the head portion 11 to communicate with the shaft channel 12. On the other hand, the shaft 20 has a sliding end portion 21 and a hitting tip 22.

The dual action arrangement comprises a tubular shaft housing 31 and a tubular elastic element 32, wherein the tubular shaft housing 31 is detachably mounted at the head opening 13 of the dart barrel 10, wherein the shaft housing 31 has a sliding slot 311 coaxially aligning with the shaft channel 12 for the sliding end portion 21 of the shaft 20 sliding therealong.

The tubular elastic element 32 is coaxially mounted at the sliding end portion 21 of the shaft 20 for applying an urging force against an inner circumferential wall 312 of the sliding slot 311 so as to minimize a clearance between the sliding slot 311 and the sliding end portion 21 of the shaft 20 while the sliding end portion 21 of the shaft 20 is allowed to linearly slide along the shaft channel 12 during an impact force at the hitting tip 22 of the shaft 20.

According to the preferred embodiment of the present invention, the dart barrel 10 further has a tail portion 14 rearwardly extended from the head portion 11, wherein the dart further comprises a rotating hinge 40 provided on the dart barrel 10 to rotatably and adjustably connect the tail portion 14 with the head portion 11 such that the head portion 11 is allowed to rotate with respect to the tail portion 12 so as to drive the shaft 20 rotating with respect to the dart barrel 10 in an adjustable manner. In other words, the rotating hinge 40 is adjustable to determine the extent to which the head portion 11 of the dart barrel 10 can be rotated with respect to the tail portion 12.

The dart further comprises a retention arrangement 50 provided on the sliding end portion 21 of the shaft 20, wherein the retention arrangement 50 comprises at least one retention guider 51 integrally and outwardly protruded from the sliding end portion 21 of the shaft 20, and has a retention slot 52 longitudinally extended on the inner circumferential wall 312 of the tubular shaft housing 31 for the retention guider 51 linearly sliding along the retention slot 52. As shown in FIG. 1 of the drawings, a width of the retention slot 52 is slightly larger than a width of the retention guider 51 so that when the retention guider 51 is sliding along the retention slot 52, a relative rotation movement between the shaft 20 and the head portion 11 of the dart barrel 10 is substantially restricted. As a result, when the dart is hit on a target (such as a dart board), unnecessary vibration of the shaft 20 with respect to the head portion 11 of the dart barrel 10 is minimized so as to maximize a stability of the dart when it is thrown to the target.

The retention slot 52 has an open end 521 formed at an opening edge of the tubular shaft housing 31 and a blocking end 522 arranged when the shaft 20 is linearly slid along the sliding slot 311 away from the dart barrel 10, the retention guider 51 is blocked at the blocking end 522 of the retention slot 52 to substantially restrict a further linear sliding movement of the shaft 20.

The dart barrel 10 is preferably elongated in shape for forming streamline geometry of the dart so that it is capable of traveling in air for hitting the target without experiencing significant air resistance. In order to increase a stability of the dart when it is being thrown to the target, the dart further comprises a flyer stabilizer 60 provided at the tail portion 14 of the dart barrel 10, wherein the flyer stabilizer 60 comprises a plurality of stabilizing fins radially extended from the tail portion 14 of the dart barrel 10 for balancing aerodynamics forces exerting to the dart barrel 10 when the dart is being thrown to the target.

According to the preferred embodiment of the present invention, a diameter of the shaft 20 is slightly smaller than a diameter of the sliding slot 311 of the tubular shaft housing 31 so that the shaft is capable of smoothly sliding along the sliding slot 311, wherein the tubular elastic element 32 comprises an elastic O-ring coaxially mounted at the sliding end portion 21 of the shaft 20 for filling the clearance between the sliding end portion 21 of the shaft 20 and the tubular shaft housing 31 so as to substantially restrict any lateral movement between the sliding end portion 21 of the shaft 20 and the tubular shaft housing 31. In other words, the elastic O-ring is adapted to absorb vibration induced at the sliding end portion 21 of the shaft 20 when it hits the target so as to minimize unnecessary movement of the shaft 20 for enhancing an accuracy of the dart hitting a predetermined target.

It is worth mentioning that the tubular elastic element 32, having a predetermined elasticity, may be replaceably mounted at the sliding end portion 311 that the tubular elastic element 32 is selectively interchanged to adjust the urging force against the inner circumferential wall 312 of the sliding slot 311 with respect to the elasticity of the tubular elastic element 32. In other words, the user of the present invention may be provided with a set of tubular elastic elements 32 for suiting different applications.

More specifically, the tubular shaft housing 31 has an enlarged front portion 313 and a rear connecting portion 314 defining the inner circumferential wall 312 of the tubular shaft housing 31 as a sidewall of the rear connecting portion 314, wherein the sliding slot 311 is longitudinally extended through the enlarged front portion 313 and the rear connecting portion 314 for slidably receiving the sliding end portion 21 of the shaft 20.

It is worth mentioning that the tubular shaft housing 31 is meant to be detachably mounted on the head portion 11 of the dart barrel 10. Therefore, an outer circumferential surface of the sidewall of the rear connecting portion 314 is threaded while an inner circumferential surface of the shaft channel 12 of the head portion 11 is correspondingly bored so that the tubular shaft housing 31 is adapted to detachably connect with the head portion 11 by screwing the rear connecting portion 314 into the shaft channel 12, wherein the sliding end portion 21 of the shaft 21 is adapted to slide in sliding slot 311 and the shaft channel 12.

In other words, the sliding movement of the sliding end portion 21 of the shaft 20 is limited by an upper end of the shaft channel 12 and the blocking end 522 of the retention slot 52 of the retention arrangement 50, so that the sliding end portion 21 of the shaft 20 can only slide in between these two terminals.

The operation of the present invention may be elaborated as follows: a user may throw the dart towards a predetermined target (such as a dart board) in the same manner as conventional dart, when the dart hits the target, any unnecessary vibrations which are responsible to induce lateral movement between the shaft 20 and the dart barrel 10 is substantially absorbed and resisted by the tubular elastic element 32 while the shaft 20 is allowed to longitudinally slide in the shaft channel 21 along the retention slot 52. As a result, when the dart is thrown towards the target, the location at which it is hit will be solely determined by the accuracy of that particular throwing, without being affected by such collateral and undesirable factors as unnecessary vibrations and unwanted rotation of the shaft 20.

Figure 3A:
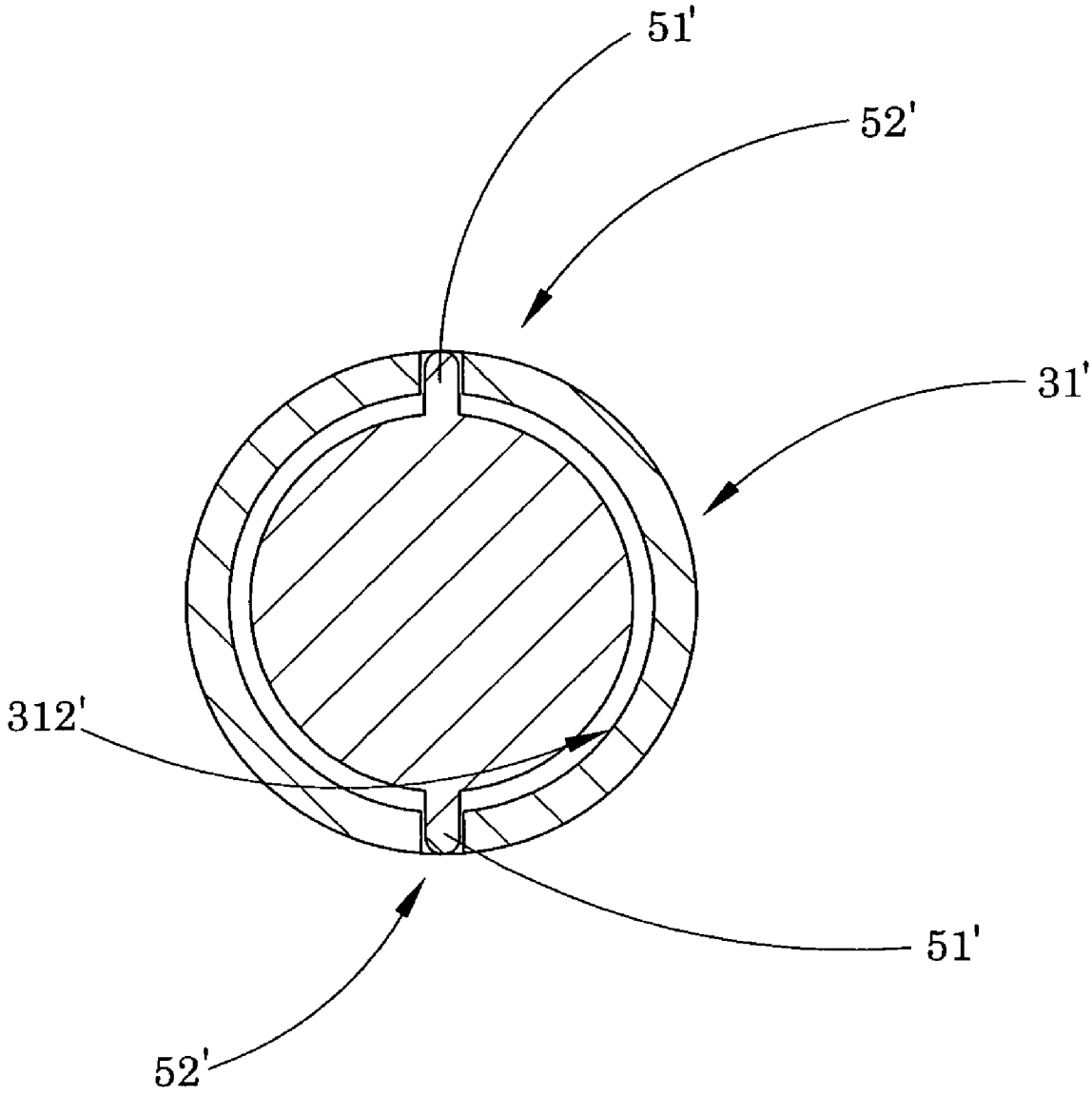
FIG. 3A to FIG. 3C are schematic diagrams of a first alternative mode of the dart according to the above preferred embodiment of the present invention, illustrating that the retention arrangement comprises a plurality of retention guiders and has a plurality of sliding slots.
Figure 3B:
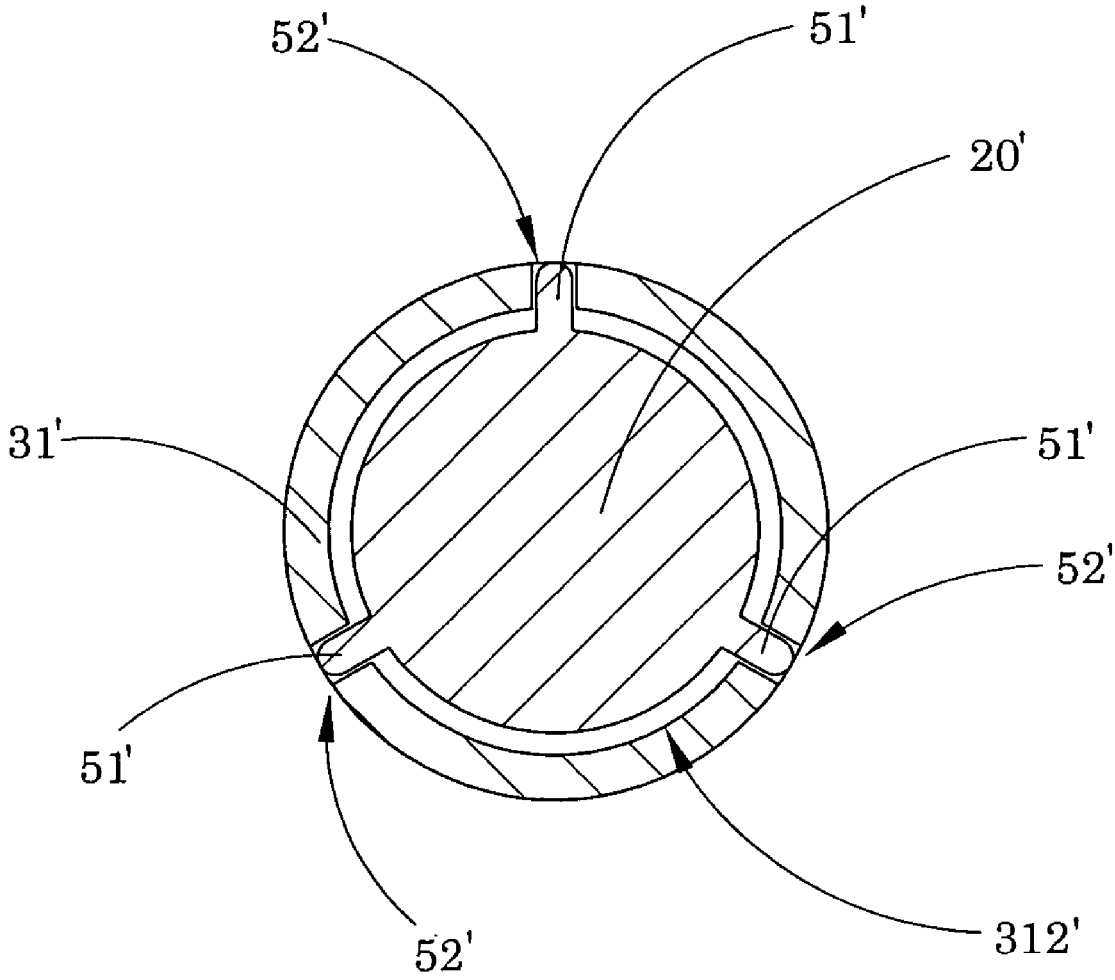
Figure 3C:
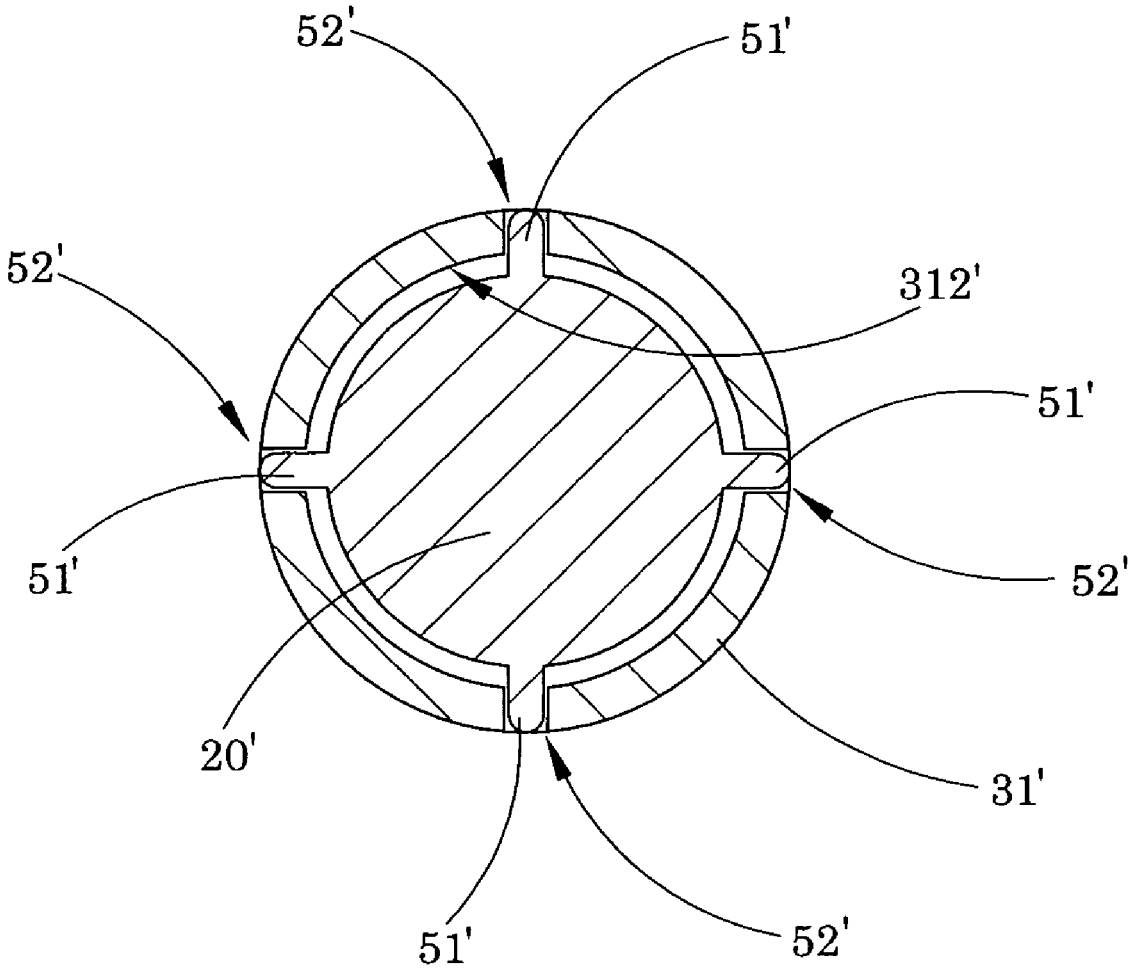

Referring to FIG. 3A to FIG. 3C of the drawings, an alternative mode of the dart according to the preferred embodiment of the present invention is illustrated. The alternative mode is similar to the preferred embodiment except the retention guider 51'. According to the alternative mode, the retention arrangement comprises a plurality of retention guiders 51' integrally and outwardly protruded from the sliding end portion 21' of the shaft 20', and has a plurality of retention slots 52' longitudinally extended on the inner circumferential wall 312' of the tubular shaft housing 31' for the retention guiders 51' sliding along the retention slots 52' respectively. FIG. 3A to FIG. 3C respectively illustrate that there are two, three and four retention guiders 51' and sliding slots 52' for preventing rotational movement of the shaft 20' with respect to the dart barrel 10.

Figure 4:
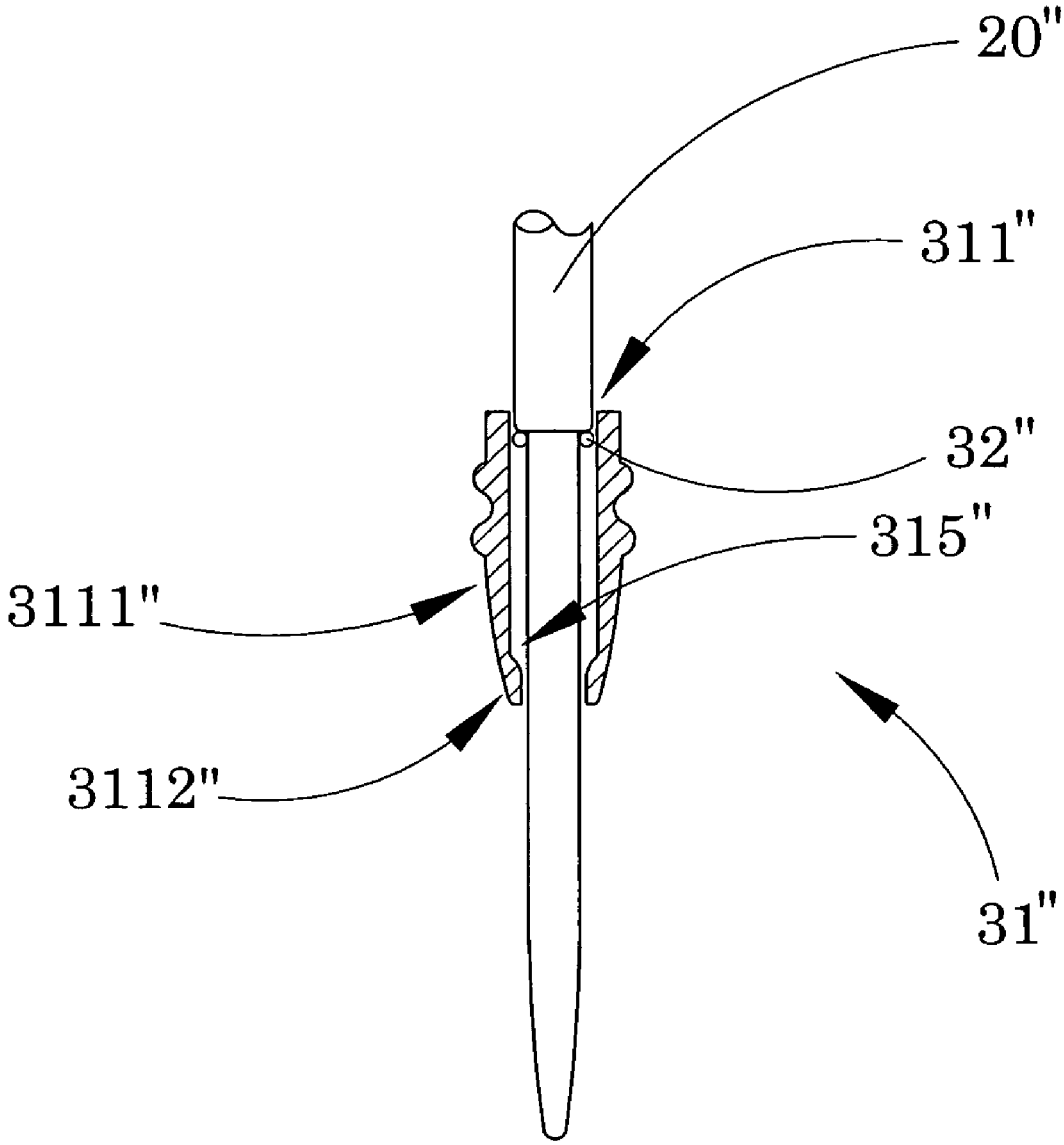
FIG. 4 is a second alternative mode of the dart according to the above preferred embodiment of the present invention.

Referring to FIG. 4 of the drawings, a second alternative mode of the dart according to the preferred embodiment of the present invention is illustrated. The second alternative mode is similar to the preferred embodiment except the dual action arrangement. According to the second alternative mode, the sliding slot 311" of the tubular shaft housing 31" has an enlarged slot portion 3111" and a contracted slot portion 3112" having a diameter smaller than a diameter of the enlarged slot portion 3111" to define a retention shoulder 315" formed by the inner sidewall of the tubular shaft housing 311" as a boundary between the enlarged slot portion 3111" and the contracted slot portion 3112" for blocking a downward movement of the tubular elastic element 32" and the shaft 20".

As a result, it is important to realize that in order to ensure smooth sliding movement of the shaft 20" within the limit of the sliding slot 311", the diameters of the enlarged slot portion 3111" and the contracted slot portion 3112" are both larger than a diameter of the shaft 20".

It is also worth mentioning that the dual action arrangement may comprise a plurality of tubular elastic elements 32" spacedly and coaxially mounted on the shaft 20" for normally biasing against the inner circumferential wall of the sliding slot 311".

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A dart, comprising:

a dart barrel having a head portion and a shaft channel coaxially extending at said head portion, and defining a head opening at said head portion to communicate with said shaft channel;

a shaft having a sliding end portion and a hitting tip; and a dual action arrangement, which comprises:

a tubular shaft housing detachably mounted at said head opening of said dart barrel, wherein said shaft housing has a sliding slot coaxially aligning with said shaft channel for said a sliding end portion of said shaft sliding therealong; and at least a tubular elastic element coaxially mounted at said sliding end portion of said shaft for applying an urging force against an inner circumferential wall of said sliding slot so as to minimize a clearance between said sliding slot and said sliding end portion of said shaft while said sliding end portion of said shaft is allowed to linearly slide along said shaft channel, wherein said sliding slot of said tubular shaft housing has an enlarged slot portion and a contracted slot portion having a diameter smaller than a diameter of said enlarged slot portion to define a retention shoulder formed at said inner circumferential wall of said tubular shaft housing as a boundary between said enlarged slot portion and said contracted slot portion for blocking a downward movement of said shaft along said sliding slot when said elastic element biases against said retention shoulder.

2. A dart, comprising:

a dart barrel having a head portion and a shaft channel coaxially extending at said head portion, and defining a head opening at said head portion to communicate with said shaft channel;

a shaft having a sliding end portion and a hitting tip; and a dual action arrangement, which comprises:

a tubular shaft housing detachably mounted at said head opening of said dart barrel, wherein said shaft housing has a sliding slot coaxially aligning with said shaft channel for said a sliding end portion of said shaft sliding therealong; and at least a tubular elastic element coaxially mounted at said sliding end portion of said shaft for applying an urging force against an inner circumferential wall of said sliding slot so as to minimize a clearance between said sliding slot and said sliding end portion of said shaft while said sliding end portion of said shaft is allowed to linearly slide along said shaft channel, wherein said elastic element comprises an elastic O-ring coaxially mounted at said sliding end portion of said shaft for filling said clearance between said sliding end portion and said tubular shaft housing, wherein said sliding slot of said tubular shaft housing has an enlarged slot portion and a contracted slot portion having a diameter smaller than a diameter of said enlarged slot portion to define a retention shoulder formed at said inner circumferential wall of said tubular shaft housing as a boundary between said enlarged slot portion and said contracted slot portion for blocking a downward movement of said shaft along said sliding slot when said elastic element biases against said retention shoulder.

3. A dart, comprising:

a dart barrel having a head portion and a shaft channel coaxially extending at said head portion, and defining a head opening at said head portion to communicate with said shaft channel;

a shaft having a sliding end portion and a hitting tip; and a dual action arrangement, which comprises:

a tubular shaft housing detachably mounted at said head opening of said dart barrel, wherein said shaft housing has a sliding slot coaxially aligning with said shaft channel for said a sliding end portion of said shaft sliding therealong; and at least a tubular elastic element coaxially mounted at said sliding end portion of said shaft for applying an urging force against an inner circumferential wall of said sliding slot so as to minimize a clearance between said sliding slot and said sliding end portion of said shaft while said sliding end portion of said shaft is allowed to linearly slide along said shaft channel, wherein said elastic element comprises an elastic O-ring coaxially mounted at said sliding end portion of said shaft for filling said clearance between said sliding end portion and said tubular shaft housing, wherein said elastic element, having a predetermined elasticity, is replaceably mounted at said sliding end portion that said elastic element is selectively interchanged to adjust said urging force against said inner circumferential wall of said sliding slot with respect to said elasticity of said elastic element, wherein said sliding slot of said tubular shaft housing has an enlarged slot portion and a contracted slot portion having a diameter smaller than a diameter of said enlarged slot portion to define a retention shoulder formed at said inner circumferential wall of said tubular shaft housing as a boundary between said enlarged slot portion and said contracted slot portion for blocking a downward movement of said shaft along said sliding slot when said elastic element biases against said retention shoulder.

4. The dart, as recited in claim 3, further comprising a flyer stabilizer provided at a tail portion of said dart barrel, wherein said flyer stabilizer comprises a plurality of stabilizing fins radially and outwardly extended from said tail portion of said dart barrel for balancing aerodynamics forces exerting to said dart barrel when said dart is being thrown to a target.

5. The dart, as recited in claim 4, further comprising a rotating hinge coaxially mounted at said tail portion of said dart barrel in a rotatably movable manner such that said tail portion of said dart barrel is rotatably extended from said head portion thereof.

* * * * *